US008538282B2

(12) United States Patent
Inukai

(10) Patent No.: US 8,538,282 B2
(45) Date of Patent: Sep. 17, 2013

(54) IMAGE FORMING APPARATUS AND METHOD FOR CONTROLLING CHARGER

(75) Inventor: Katsumi Inukai, Iwakura (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 346 days.

(21) Appl. No.: 13/069,549

(22) Filed: Mar. 23, 2011

(65) Prior Publication Data

US 2012/0051772 A1 Mar. 1, 2012

(30) Foreign Application Priority Data

Aug. 27, 2010 (JP) ..... 2010-190989

(51) Int. Cl.
*G03G 15/02* (2006.01)

(52) U.S. Cl.
USPC ..... 399/50; 399/37; 399/89; 399/90; 399/171

(58) Field of Classification Search
USPC ..... 399/37, 50, 89, 90, 171
See application file for complete search history.

(56) References Cited

U.S. PATENT DOCUMENTS

| | | | | |
|---|---|---|---|---|
| 4,891,572 | A | 1/1990 | Suzuki | |
| 5,572,295 | A | 11/1996 | Sakagami et al. | |
| 5,666,591 | A * | 9/1997 | Taya | 399/50 |
| 8,019,241 | B2 | 9/2011 | Hamaya | |
| 2007/0147858 | A1 * | 6/2007 | Inukai | 399/31 |
| 2009/0052915 | A1 | 2/2009 | Claflin, Jr. et al. | |
| 2009/0060535 | A1 | 3/2009 | Hamaya | |
| 2010/0080592 | A1 * | 4/2010 | Hamaya et al. | 399/50 |
| 2010/0080593 | A1 | 4/2010 | Inukai et al. | |
| 2010/0196043 | A1 * | 8/2010 | Hamaya | 399/88 |
| 2010/0278547 | A1 * | 11/2010 | Maruyama et al. | 399/89 |

FOREIGN PATENT DOCUMENTS

| | | |
|---|---|---|
| JP | 01-108578 A | 4/1989 |
| JP | 02-130571 A | 5/1990 |
| JP | 03-089264 A | 4/1991 |
| JP | 03-142483 | 6/1991 |
| JP | 03-152576 A | 6/1991 |
| JP | 05-323773 | 12/1993 |
| JP | 06-230656 A | 8/1994 |
| JP | 07-244420 | 9/1995 |

(Continued)

OTHER PUBLICATIONS

Extended EP Search Report dtd Dec. 1, 2011, EP Appln. 11159058.4.

(Continued)

*Primary Examiner* — Ryan Walsh
(74) *Attorney, Agent, or Firm* — Banner & Witcoff, Ltd.

(57) ABSTRACT

An image forming apparatus including: one or a plurality of photosensitive drums; a plurality of chargers each having a grid, a voltage applying unit generating a charging voltage; a plurality of grid constant voltage circuits, each of the plurality of grid constant voltage circuits including: a voltage detecting unit that detects a voltage based on a grid voltage which is generated in the grid; a first current detecting unit detecting a first current; a voltage control line making the grid voltage constant; and an operation control device performing a feedback control such that the detected voltage has a predetermined voltage value; at least one of a second current detecting units detecting a second current flowing; and a controller controlling the voltage applying unit such that a sum of the first current and the second current corresponding to one of the plurality of chargers becomes a predetermined current value.

10 Claims, 5 Drawing Sheets

(56) References Cited

FOREIGN PATENT DOCUMENTS

| | | | |
|---|---|---|---|
| JP | 08-054768 | | 2/1996 |
| JP | 09-230675 | A | 9/1997 |
| JP | 11-133765 | | 5/1999 |
| JP | 2007-086229 | | 4/2007 |
| JP | 2009-053422 | A | 3/2009 |

OTHER PUBLICATIONS

JP Decision of Patent Grant dtd May 15, 2012, JP Appln. 2010-190989, English Translation.

* cited by examiner

IMAGE FORMING APPARATUS AND METHOD FOR CONTROLLING CHARGER

CROSS REFERENCE TO RELATED APPLICATION

The present application claims priority from Japanese Patent Application No. 2010-190989, which was filed on Aug. 27, 2010, the disclosure of which is herein incorporated by reference in its entirety.

TECHNICAL FIELD

Apparatuses and devices consistent with the present invention relate to an image forming apparatus and a method for controlling a charger, and more particularly, to a technique of controlling a plurality of chargers used for an image forming apparatus when a common charging voltage is applied to the plurality of chargers.

BACKGROUND

For example, Patent Document 1 discloses a technique which controls a plurality of chargers when a common charging voltage is applied to the plurality of chargers. More specifically, Patent Document 1 discloses a technique in which power is supplied from one high voltage power supply unit to a plurality of corona chargers.

RELATED ART DOCUMENT

Patent Document

[Patent Document 1] JP-H03-142483-A

SUMMARY

The technique disclosed in Patent Document 1 provides a common circuit to apply a charging voltage to a plurality of corona chargers in common, which may result in an inexpensive and compact high voltage power supply circuit. When the voltage applying circuit is provided in common, each grid voltage is made constant and a grid current is controlled to be made constant based on one grid current value rather than a plurality of grid current values. However, to this end, there is a need for making the grid current and the grid voltage constant with high precision.

The invention provides a technique which is capable of making a grid current and a grid voltage constant with high precision in a configuration where a voltage applying circuit applies a charging voltage to a plurality of chargers in common.

According to a first illustrative aspect of the present invention, there is provided an image forming apparatus comprising: one or a plurality of photosensitive drums; a plurality of chargers each having a grid, which are provided for the one photosensitive drum or are respectively provided for the plurality of photosensitive drums and charge the one or plurality of photosensitive drums; a voltage applying unit that generates a charging voltage and applies the generated charging voltage to the plurality of chargers in common; a plurality of grid constant voltage circuits which are respectively provided for the plurality of chargers, each of the plurality of grid constant voltage circuits including: a voltage detecting unit that detects a voltage based on a grid voltage which is generated in the grid in accordance with the applied charging voltage; a first current detecting unit that detects a first current flowing into the voltage detecting unit; a voltage control line that makes the grid voltage constant; and an operation control device that performs a feedback control through the voltage control line such that the detected voltage detected by the voltage detecting unit has a predetermined voltage value; at least one of a second current detecting units which are respectively provided for at least one of the grid constant voltage circuits, and detect a second current flowing into the voltage control line; and a controller that controls the voltage applying unit such that a sum of the first current and the second current corresponding to one of the plurality of chargers becomes a predetermined current value.

With this configuration, each grid voltage is made constant by feedback control using an operation control device instead of a plurality of constant voltage elements having an element imbalance. In this case, although some of the grid current is flowed into a feedback circuit, the grid current is made constant in consideration of the flowed current (first current). Accordingly, in the configuration where the voltage applying circuit applies the charging voltage to the plurality of chargers in common, it is possible to make each grid voltage constant with high precision. In addition, any charger can be controlled to have a constant current with high precision. For example, by controlling a charger having the most contaminated discharging wire, that is, a charger having the minimal grid current, to have a constant current, it is possible to charge the photosensitive drums sufficiently even with the charger having the most contaminated discharging wire.

According to a second illustrative aspect of the present invention, in addition to the first aspect, a plurality of the second current detecting units are respectively provided for the plurality of grid constant voltage circuits, and wherein the controller determines whether or not the second current detecting unit corresponding to one of the chargers detects a minimal second current, and controls the voltage applying unit such that the sum of the first current and the second current corresponding to the charger in which the minimal second current is detected has the predetermined current value.

With this configuration, it is possible to charge the photosensitive drums sufficiently even with the charger having the most contaminated discharging wire, that is, the charger having the minimal grid current.

According to a third illustrative aspect of the present invention, in addition to the first aspect or the second aspect, each of the grid constant voltage circuits is connected to an output side of the respective operation control device and includes a transistor which controls a voltage of the respective voltage control line, and wherein each of the second current detecting units detects the respective second current between the transistor and a ground.

With this configuration, for example, by performing a feedback control to adjust a base voltage of a bipolar transistor to a predetermined voltage by an output of the operation control device, a collector-emitter voltage can be adjusted to a predetermined voltage. Accordingly, the grid voltage can be made constant with higher precision.

According to a fourth illustrative aspect of the present invention, in addition to the third aspect, the transistor includes a control terminal, wherein each of the second current detecting units includes a first resistive element which generates a voltage detection signal for detecting the second current, and wherein the controller makes the voltage of the voltage control line constant by controlling a voltage of the control terminal of the transistor based on a voltage value of the voltage detection signal.

With this configuration, since a voltage value of the voltage detection signal is varied depending on the grid current, the grid voltage can be made constant as the predetermined voltage by changing the collector-emitter voltage of the transistor based on the grid current. That is, a surface potential of the photosensitive drums can be changed to a predetermined value based on the grid current.

According to a fifth illustrative aspect of the present invention, in addition to the third aspect or the fourth aspect, each of the grid constant voltage circuits includes a phototransistor as the transistor.

With this configuration, since a base-emitter current of the transistor can be reduced, the second current, that is, the grid current, can be detected with high precision.

According to a sixth illustrative aspect of the invention, in addition to any one of the third to fifth aspects, the transistor includes a first terminal and a second terminal, and wherein each of the grid constant voltage circuits includes: a second resistive element, which is interposed between the grid and the first terminal of the transistor, in the voltage control line; and a third resistive element or a constant voltage element, which is interposed between the first terminal and the second terminal of the transistor, in the voltage control line.

With this configuration, a first terminal-second terminal voltage of the transistor can be limited to a withstanding voltage, which may result in improved reliability of the transistor.

According to a seventh illustrative aspect of the invention, in addition to any one of the third to fifth aspects, each of the grid constant voltage circuits includes a constant voltage element, which is interposed between the grid and the transistor, in the voltage control line.

With this configuration, a collector-emitter or source-drain voltage of the transistor can be limited to a withstanding voltage, which may result in improved reliability of the transistor.

According to an eighth aspect of the invention, in addition to any one of the first to seventh aspects, the controller controls each of the grid constant voltage circuits such that as a second current detected by the respective second current detecting unit increases, a predetermined constant voltage decreases.

Typically, since as a grid current increases a surface potential of the photosensitive drums increases, by reducing the grid voltage as the grid current increases, it is possible to prevent the surface potential of the photosensitive drums from being unbalanced, which may result in prevention of print image quality from being deteriorated.

According to a ninth aspect of the present invention, in addition to any one of the first to eighth aspect, each of the chargers is a scorotron type charger that includes a discharging wire and the grid.

According to a tenth illustrative aspect of the present invention, there is provided a method for controlling a plurality of chargers in an image forming apparatus including a plurality of photosensitive drums, a plurality of chargers each having a grid, which are respectively provided for the plurality of photosensitive drums and charge the plurality of photosensitive drums, a voltage applying unit which generates a charging voltage and applies the generated charging voltage to the plurality of chargers in common, and a plurality of grid constant voltage circuits which are respectively provided for the plurality of chargers, each of the plurality of grid constant voltage circuits including a voltage detecting unit, an operation control device, and a voltage control line, the method comprising the steps of: detecting a voltage by the respective voltage detecting unit, based on a grid voltage generated in the respective grid in accordance with the charging voltage; making the respective grid voltage constant by the respective operation control device by performing a feedback control through the respective voltage control line such that the detected voltage detected by the respective voltage detecting unit has a predetermined voltage value; detecting a first current flowing into the respective voltage detecting unit; detecting a second current flowing into at least one of voltage control lines from the second current flowing into the respective voltage control line; and controlling the voltage applying unit such that a sum of the first current and the second current corresponding to one of the plurality of chargers has a predetermined current value.

With this configuration, like the first aspect of the invention, in the configuration where the voltage applying circuit applies the charging voltage to the plurality of chargers in common, it is possible to make each grid voltage and each grid current constant with high precision.

According to the image forming apparatus and the method of controlling the chargers, in the configuration where the voltage applying circuit applies the charging voltage to the plurality of chargers in common, it is possible to make each grid voltage and each grid current constant with high precision.

BRIEF DESCRIPTION OF THE DRAWINGS

Illustrative aspects of the invention will be described in detail with reference to the following figures wherein.

DETAILED DESCRIPTION OF EXEMPLARY EMBODIMENTS OF THE PRESENT INVENTION

First Embodiment

A first embodiment of the invention will be described with reference to FIGS. 1 and 2.

1. The Entire Structure of Printer

Figure 1:
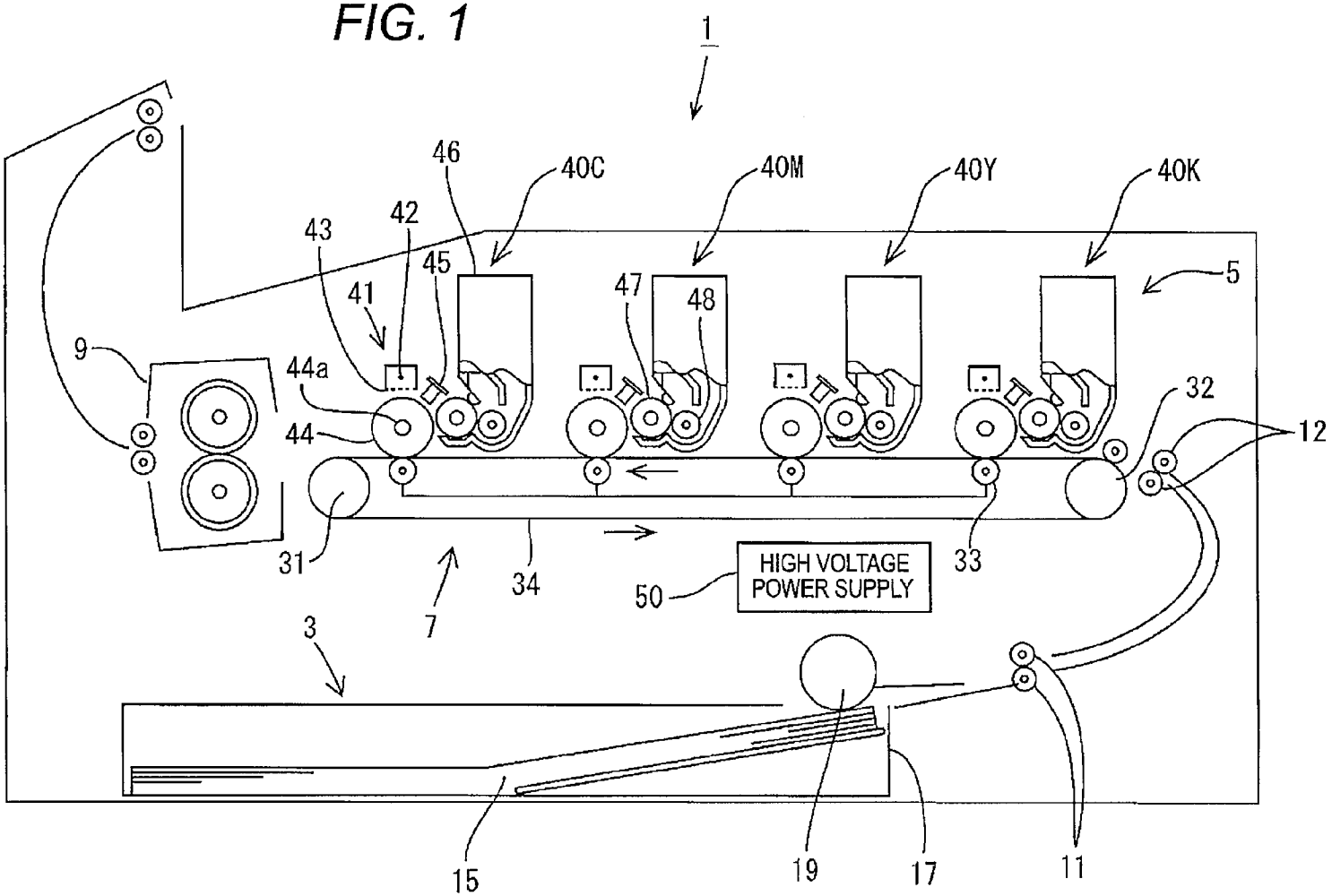
FIG. 1 is a schematic sectional view showing an internal structure of a printer according to a first embodiment of the invention.

FIG. 1 is a schematic sectional view showing an internal structure of a color printer 1 (an example of an image forming apparatus) according to a first embodiment. In the following description, subscripts such as Y (yellow), M (magenta), C (cyan) and K (black) are appended to each of the elements if they are to be differentiated from each other, but otherwise, no subscript is appended. In addition, an image forming apparatus is not limited to the color printer but may be, for example, a multifunction copier having FAX and copying functions.

The color printer (hereinafter abbreviated as a "printer") 1 includes a paper feeding section 3, an image forming section 5, a conveyance mechanism 7, a fixing section 9, and a high voltage power supply 50. For example, the printer 1 forms toner images formed of unicolor or multicolor (four colors of yellow, magenta, cyan, and black in this embodiment) toner (developer), depending on image data input from the outside, on sheets 15 (paper, an OHP sheet, or the like).

The paper feeding section 3 is arranged on the bottom of the printer 1 and includes a tray 17 which accommodates the sheets 15, and a pickup roller 19. The sheets 15 accommodated in the tray 17 are taken one by one out of the tray 17 by means of the pickup roller 19 and are sent to the conveyance mechanism 7 through a conveyance roller 11 and a registration roller 12.

The conveyance mechanism 7 serves to convey the sheets 15 and is, for example, removably mounted on a mount (not shown) formed within the printer 1. The conveyance mechanism 7 includes a driving roller 31, a driven roller 32, and a belt 34 which spans the driving roller 31 and the driven roller 32. When the driving roller 31 is rotated, a surface of the belt 34, which faces photosensitive drums 44, moves in the direction from the right side to the left side in FIG. 1. Accordingly, the sheets 15 sent from the registration roller 12 are conveyed to the image forming section 5. The conveyance mechanism 7 further includes four transfer rollers 33.

The image forming section 5 includes four process units 40Y, 40M, 40C and 40K and four exposure units 45. Each process unit 40 includes a charger 41, a photosensitive drum (an example of a photosensitive drum) 44, a unit case 46, a developing roller 47, and a feeding roller 48. Each process unit 40Y, 40M, 40C, and 40K is removably mounted on a mount (not shown) formed within the printer 1.

The photosensitive drum 44 includes, for example, an aluminum base, which is, for example, connected to a ground line of the printer 1 via a conductive shaft 44*a*, and a positively-charged photosensitive layer formed on the aluminum base. The charger 41 is, for example, a scorotron type charger and includes a discharging wire 42 and a grid 43. When a charging voltage CHG is applied to the discharging wire 42, a grid voltage GRID of the grid 43 is controlled such that a surface of the photosensitive drum 44 has substantially the same potential (for example, +700 V).

The exposure units 45 includes, for example, a plurality of light emitting devices (for example, light emitting diodes (LEDs)) arranged in a row in a rotation axial direction of the photosensitive drum 44 and forms an electrostatic latent image on the surface of the photosensitive drum 44 by controlling emission of the plurality of light emitting devices based on externally-input image data. In addition, the exposure units 45 are fixed within the printer 1. The exposure units 45 may employ a laser.

The unit case 46 accommodates toner for each color (for example, positively-charged nonmagnetic one-component toner) and includes the developing roller 47 and the feeding roller 48. The toner is fed to the developing roller 47 with a rotation of the feeding roller 48 and is positively charged by friction between the feeding roller 48 and the developing roller 47. In addition, when the toner is fed onto the photosensitive drum 44 to form a uniform toner layer thereon, the developing roller 47 develops an electrostatic latent image to form a toner image on the photosensitive drum 44.

The transfer rollers 33 are arranged to face the respective photosensitive drums 44 with the belt 34 interposed therebetween. When a transfer voltage having a polarity (a negative polarity in this example) reverse to the charged polarity of the toner is applied between the transfer rollers 33 and the photosensitive drums 44, the transfer rollers 33 transfer the toner image formed on the photosensitive drums 44 onto the sheet 15. Thereafter, the sheet 15 is conveyed to the fixing section 9 by the conveyance mechanism 7, thermally fixed with the toner image by the fixing section 9, and then discharged to the top side of the printer.

2. Configuration of High Voltage Power Supply

Figures 2, 2A, 2B:
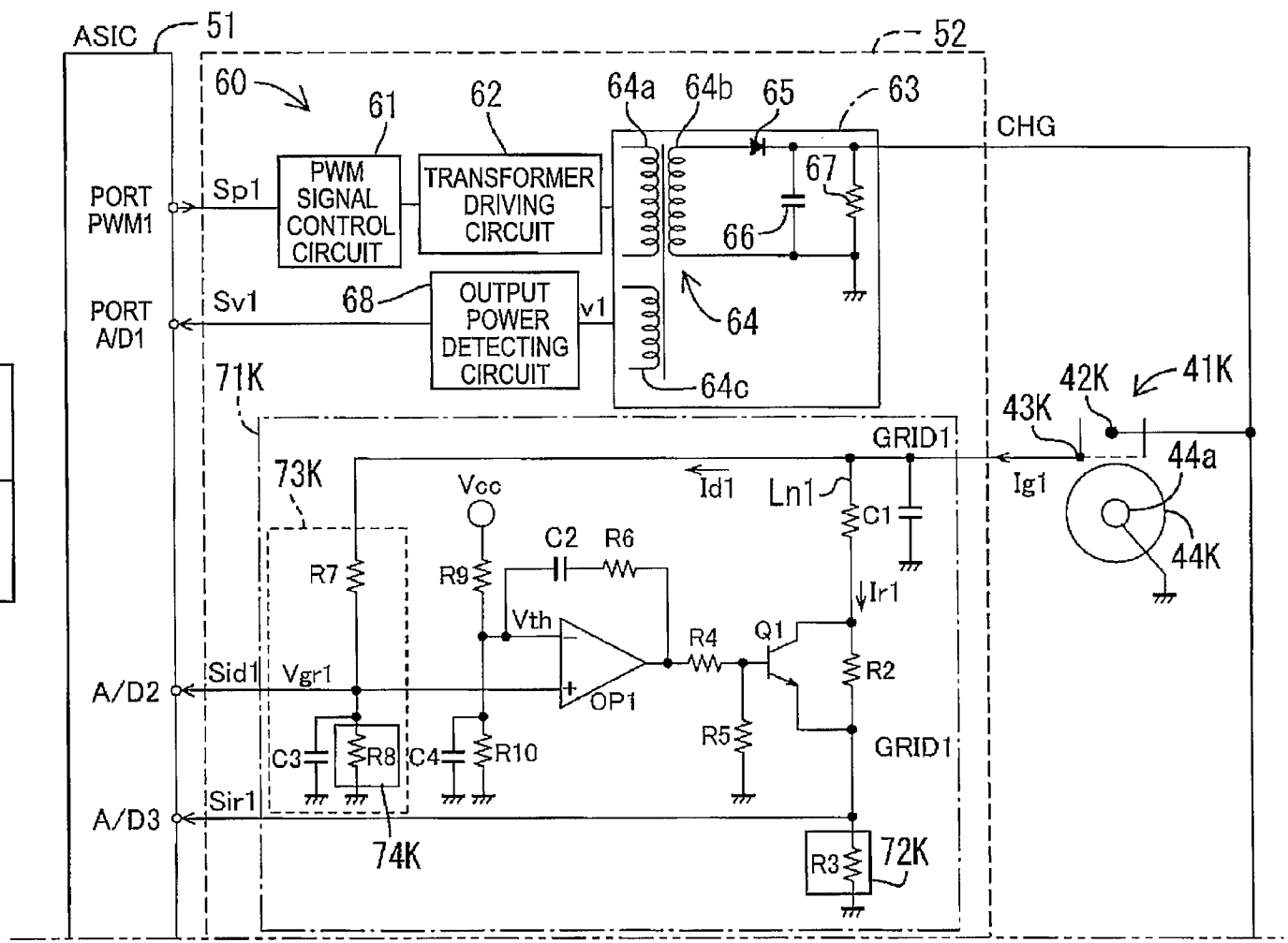
FIG. 2A and FIG. 2B show a schematic block diagram of a high voltage power supply of the printer.
Figure 2B:
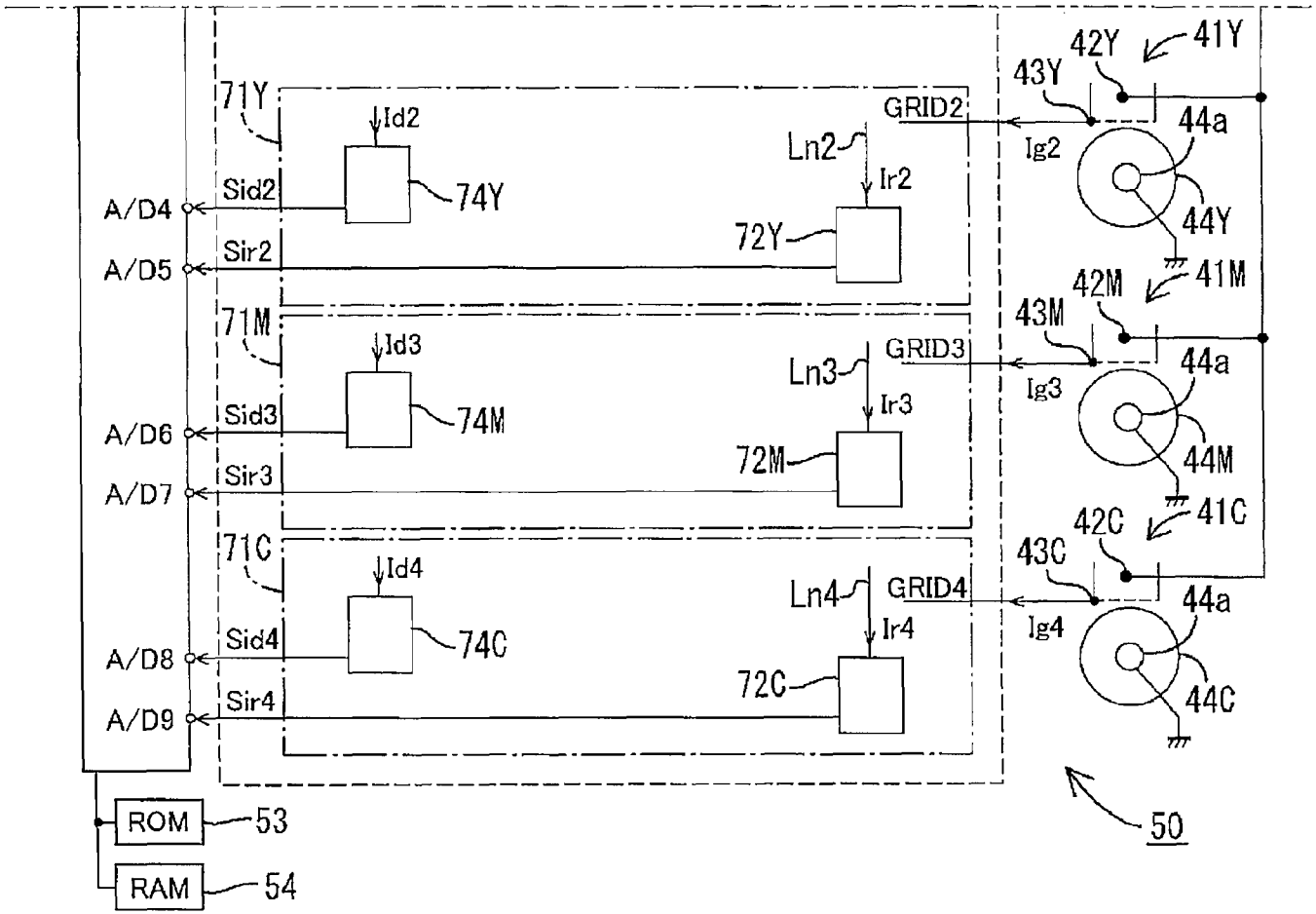

Next, an electrical configuration of the printer 1 of the invention will be described with reference to FIG. 2 (FIG. 2A and FIG. 2B). FIG. 2 shows a schematic block diagram of the high voltage power supply 50 mounted on a circuit board (not shown) and a connection configuration of the high voltage power supply 50.

The high voltage power supply 50 includes an ASIC (Application Specific Integrated Circuit: an example of a controller) 51, a high voltage power supply circuit 52 connected to the ASIC 51, a ROM 53, and a RAM 54. The ASIC 51 controls the entire printer including the high voltage power supply circuit 52. ROM 53 stores various operation programs to be executed by the ASIC 51 and the RAM 54 stores image data to be used for a printing process. The controller is not limited to the ASIC but may be, for example, a CPU.

The high voltage power supply circuit 52 includes a charging voltage generating circuit (an example of a voltage applying unit) 60, grid constant voltage circuits 71, and line current detecting circuits (an example of a second current detecting unit) 72. In this embodiment, the charging voltage generating circuit 60 is provided for chargers 41K to 41C in common and the grid constant voltage circuits 71K to 71C and the line current detecting circuits 72K to 72C are provided to correspond to the respective chargers 41K to 41C. Without being limited thereto, the line current detecting circuits 72 may be provided to correspond to at least one charger 41, that is, at least one grid constant voltage circuit 71. For example, one line current detecting circuit 72 may be provided to correspond to one particular charger 41, that is, one particular grid constant voltage circuit 71.

The charging voltage generating circuit 60 includes, for example, a PWM signal control circuit 61, a transformer driving circuit 62, a boosting circuit 63, and an output voltage detecting circuit 68.

The charging voltage generating circuit 60 generates a charging voltage CHG which is applied to the discharging wires 42K to 42C of the chargers 41K to 41C in common. Respective grid voltages GRID are generated by the common charging voltage CHG and the grid constant voltage circuits 71. The charging voltage CHG is, for example, about 5.5 kV to 7 kV and each grid voltage GRID is, for example, about 700 V.

The PWM signal control circuit 61 includes, for example, resistors and capacitors (not shown) and smoothes a PWM (Pulse Width Modulation) signal Sp1 from a port PWM1 of the ASIC 51 and supplies the smoothed PWM signal Sp1 to the transformer driving circuit 62.

The transformer driving circuit 62 is, for example, configured to flow an oscillating current into a primary winding 64*a* of a transformer 64 of the boosting circuit 63 based on the smoothed PWM signal received from the PWM signal control circuit 61. In this embodiment, a value of the charging voltage CHG is controlled based on a duty cycle of the PWM signal Sp1. For example, the charging voltage CHG generated by the boosting circuit 63 is controlled to increase with an increase of the duty cycle of the PWM signal Sp1.

The boosting circuit 63 includes, for example, the transformer 64, a rectifying diode 65, a smoothing capacitor 66, and an output resistor 67. The transformer 64 includes the primary winding 64*a*, a secondary winding 64*b*, and an auxiliary winding 64*c*.

With this configuration, a voltage of the primary winding 64*a* is boosted and rectified by the boosting circuit 63 and is applied, as the charging voltage CHG, to the discharging wires 42K to 42C of the chargers 41K to 41C.

The output voltage detecting circuit 68 is connected between the auxiliary winding 64*c* of the transformer 64 and the ASIC 51. The output voltage detecting circuit 68 includes, for example, a smoothing circuit and a voltage dividing resistor. The output voltage detecting circuit 68 detects an output voltage v1 generated between the output voltage detecting circuit 68 and the auxiliary winding 64*c* as the charging voltage CHG as an output voltage is generated, and smoothes and divides the output voltage v1 to generate an output voltage detection signal Sv1. The output voltage detection signal Sv1 is supplied to a port A/D1 of the ASIC 51.

Each grid constant circuit 71 includes a voltage detecting circuit (an example of a voltage detecting unit) 73, a shunt current detecting circuit (corresponding to a first current detecting unit) 74, a voltage control line Ln, and an operational amplifier OP1 (an example of an operation control device). The grid constant voltage circuits 71 have the same configuration and therefore only the grid constant voltage circuit 71K corresponding to a K (black) color will be explained in the following description for the purpose of simplicity.

The voltage detecting circuit 73K includes voltage dividing resistors R7 and R8 and detects a voltage Vgr1 based on the grid voltage GRID1 of the grid 43K by means of the voltage dividing resistors R7 and R8. The detected voltage Vgr1 is input to a non-inverting input terminal of the operational amplifier OP1.

In this embodiment, the shunt current detecting circuit 74K is constructed by the voltage dividing resistor R8 of the voltage detecting circuit 73K and detects a shunt current (corresponding to a first current) Id1 flowing into the voltage detecting circuit 73K. More specifically, the shunt current detecting circuit 74K generates a shunt detection signal Sid1 as a terminal voltage (equal to the detected voltage Vgr1) of the voltage dividing resistor R8 and supplies the shunt detection signal Sid1 to a port A/D2 of the ASIC 51. The ASIC 51 calculates the shunt current Id1 based on a resistance value of the voltage dividing resistor R8 and a voltage value of the shunt detection signal Sid1.

In addition, the ASIC 51 may calculate the grid voltage GRID1 based on the voltage value of the shunt detection signal Sid1 and a voltage dividing ratio between resistance values of the voltage dividing resistors R7 and R8. That is, the ASIC 51 may detect the grid voltage GRID1 based on the shunt detection signal Sid1.

The voltage control line Ln1 is a circuit which makes the grid voltage GRID1 constant, and includes resistors R1, R2, and R3 connected in series.

The operational amplifier OP1 performs a feedback control through the voltage control line Ln1 such that the detected voltage Vgr1 detected by the voltage detection circuit 73K becomes a reference voltage (corresponding to a "predetermined voltage") Vth. In this embodiment, for example, the reference voltage Vth is a voltage obtained by dividing a power supply voltage of 5 V by means of voltage dividing resistors R9 and R10 and is input to an inverting input terminal of the operational amplifier OP1. An output terminal and the inverting input terminal of the operational amplifier OP1 are connected by a resistor R6 and a capacitor C2.

In addition, a transistor Q1 is connected to the output terminal of the operation amplifier OP1. The transistor Q1 includes a collector (corresponding to a "first terminal") connected between the resistor R1 (corresponding to a "second resistive element") and the resistor R2 (corresponding to a "third resistive element") and an emitter (corresponding to a "second terminal") connected between the resistor R2 and the resistor R3. The transistor Q1 changes a collector-emitter voltage as a base current is controlled by the operational amplifier OP1. Accordingly, the grid voltage GRID is adjusted.

In this embodiment, the resistor R2 is provided between the collector and the emitter of the transistor Q1 and resistance values of the resistors R1, R2, and R3 are set such that a voltage across the resistor R2 falls within a withstanding voltage between the collector and the emitter. Accordingly, reliability of the transistor Q1 is improved and the grid constant voltage circuit 71 is improved. In addition, the transistor Q1 is not limited to a bipolar transistor but may be an FET (Field Effect Transistor). In addition, a constant voltage element such as a Zener diode or the like may be used instead of the resistor R2. A voltage of the constant voltage element is set to fall within the withstanding voltage between the collector and the emitter of the transistor Q1.

That is, the operational amplifier OP1 changes the grid voltage GRID by changing a base voltage (corresponding to a "control terminal voltage") such that the detected voltage Vgr1 becomes the reference voltage Vth in the feedback control. In addition, as the detected voltage Vgr1 becomes the reference voltage Vth by the feedback control, the grid voltage GRID1 is made constant as a predetermined voltage.

In addition, the line current detecting circuit 72K (corresponding to a "second current detecting unit") which detects a line current (corresponding to a "second current") Ir1 flowing into the voltage control line Ln1 between the transistor Q1 and GND is provided between the transistor Q1 and GND. In this embodiment, the line current detecting circuit 72K is constructed by the resistor R3 provided in the voltage control line Ln1. The line current detecting circuit 72K generates a line current detection signal (corresponding to a "voltage detection signal") Sir1 as a terminal voltage across the resistor R3 (corresponding to a "first resistive element") and supplies the line current detection signal Sir1 to a port A/D3 of the ASIC 51. The ASIC 51 calculates the line current Ir1 based on a resistance value of the resistor R3 and a voltage value of the line current detection signal Sir1. In addition, the ASIC 51 obtains a grid current Ig1 by adding the shunt current Id1 to the line current Ir1.

Capacitors C1, C3, C4, and so on are charging capacitors which delay voltages generated in the respective resistors.

The ASIC 51 controls the charging voltage generating circuit 60 such that the sum (the grid current Ig) of the shunt current Id and the line current Ir corresponding to one of the four chargers 41K to 41C has a predetermined current value. In this embodiment, the ASIC 51 determines whether or not the line current detecting circuit 72 corresponding to any charger 41 detects a minimal line current Ir, and controls the charging voltage generating circuit 60 in a constant current mode such that the sum (the grid current Ig) of the shunt current Id and the line current Ir corresponding to the charger 41 in which the minimal line current Ir is detected has a predetermined current value, for example, 250 μA. In this embodiment, it is assumed that the charger 41 in which the minimal line current Ir is detected is a charger 41 having the most contaminated discharging wire 42. This is because a discharging current, that is, the grid current Ig, is typically decreased depending on a degree of contamination of the discharging wire 42.

One charger 41 controlled in a constant current mode is not limited to the charger 41 in which the minimal line current Ir is detected, but may be appropriately selected according to the use situation of the printer 1.

3. Control Operation of Charger

Next, a control operation of the plurality of (four in this embodiment) chargers 41 in the printer 1 including the charging voltage generating circuit 60 and the plurality of (four in this embodiment) grid constant voltage circuits 71 as configured above will be described. In this embodiment, a control operation related to making the grid voltage GRID of the chargers 41 constant will be described.

First, based on application of a predetermined charging voltage CHG to each charger 41 by the charging voltage generating circuit 60, each voltage detecting circuit 73 of each grid constant voltage circuit 71 detects the voltage Vgr according to the grid voltage GRID of each grid 43 by means of the voltage dividing resistors R7 and R8.

Subsequently, each grid voltage GRID is made constant as each operational amplifier OP1 performs a feedback control through each voltage control line Ln such that the detected voltage Vgr detected by each voltage detecting circuit 73 becomes the reference voltage Vth. At this point, each shunt current detecting circuit 74 and the ASIC 51 each detects each shunt current Id flowing into each voltage detecting circuit 73.

In addition, each line current detecting circuit 72 and the ASIC 51 each detects the line current Ir flowing into each voltage control line Ln.

In addition, the ASIC 51 controls the charging voltage generating circuit 60 such that the sum of the shunt current Id and the line current Ir corresponding to one of the four chargers 41 has a predetermined current value, for example, 250 μA. Preferably, the ASIC 51 determines whether or not the line current detecting circuit 72 corresponding to any charger 41 detects a minimal line current Ir, and controls the charging voltage generating circuit 60 such that the sum of the shunt current Id and the line current Ir corresponding to the charger 41 in which the minimal line current Ir is detected has a predetermined current value, for example, 250 μA. At this time, the charging voltage CHG generated by the charging voltage generating circuit 60 is applied to the chargers 41 in common.

In this manner, in this embodiment, the charging voltage generating circuit 60 performs a constant current control operation such that the grid current Ig of one of the four chargers 41 is made constant. On the other hand, the grid voltage GRID of each charger 41 is constant voltage-controlled by each grid constant voltage circuit 71. At this point, grid voltages GRID controlled to be made constant may have the same or different voltage values.

4. Effects of Embodiment

In this embodiment, each grid voltage GRID is made constant by the feedback control using the operation amplifier OP1 instead of a plurality of constant voltage elements having an element imbalance, for example a plurality of Zener diodes. Making the grid voltage GRID constant is less affected by the element imbalance in using the feedback control than using the constant voltage elements. In this case, although some (shunt current) Id of the grid current is flowed into a feedback circuit such as the voltage detecting circuit 73 or the like, the grid current Ig is made constant as a predetermined current value in consideration of the flowed current Id.

Accordingly, with the configuration where the charging voltage generating circuit 60 applies the charging voltage CHG to the plurality of chargers 41 in common, it is possible to make each grid voltage GRID constant with high precision. In addition, since a charger 41 having the most contaminated discharging wire 42, that is, a charger 41 having the minimal grid current Ig, is controlled to have a constant current with high precision, it is possible to charge the photosensitive drums 44 sufficiently even with the charger 41 having the most contaminated discharging wire 42.

Second Embodiment

Next, an image forming apparatus according to a second embodiment of the invention will be described with reference to FIG. 3. The second embodiment has the same configuration as the first embodiment except the configuration of the grid constant voltage circuit. Therefore, only the grid constant voltage circuit 71 will be explained for the purpose of simplicity.

Figure 3:
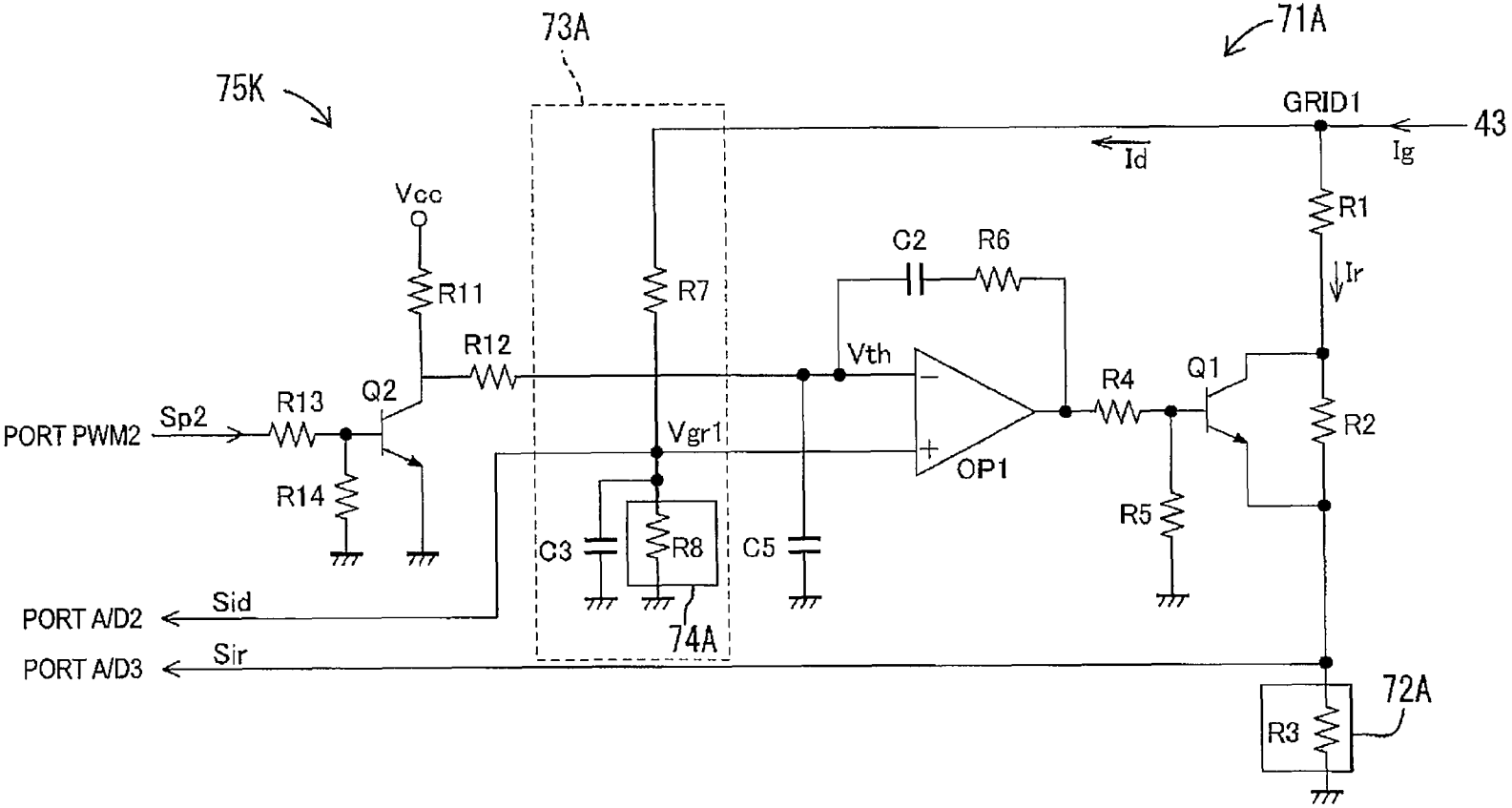
FIG. 3 is a circuit diagram showing a grid constant voltage circuit according to a second embodiment of the invention.

FIG. 3 is a circuit diagram showing a configuration of a grid constant voltage circuit according to the second embodiment. The grid constant voltage circuit for each color has the same configuration as a grid constant voltage circuit 71A shown in FIG. 3.

The grid constant voltage circuit 71A of the second embodiment includes a reference voltage adjusting circuit 75A which adjusts the reference voltage Vth, in addition to the grid constant voltage circuit 71 of the first embodiment. The reference voltage adjusting circuit 75A includes, as main components, a transistor Q2 and smoothing circuits R12 and C5.

The transistor Q2 is turned on/off by a PWM signal Sp2 supplied from a port PWM2 of the ASIC 51. The smoothing circuit R12 and C5 includes a resistor R12 and a capacitor C5 and generates the reference voltage Vth by smoothing a connector output of the transistor Q2. That is, the reference voltage Vth is adjusted (changed) by changing a pulse width of the PWM signal Sp2 and, accordingly, a value of the grid voltage GRID to be made constant is adjusted (changed) with the adjustment of the reference voltage Vth. Resistors R13 and R14 serve to adjust a base current of the transistor Q2 to an appropriate level.

At this point, an ASIC 51 generates the PWM signal Sp2 based on a line current detection signal Sir generated by a line current detecting circuit 72A. That is, the ASIC 51 adjusts the reference voltage Vth based on the line current detection signal (voltage value) Sir and adjusts (changes) a voltage (grid voltage GRID) of the voltage control line to be made constant by controlling the base voltage of the transistor Q1 based on the adjusted reference voltage Vth.

Accordingly, although the line current detection signal Sir is changed with the grid current Ig, the grid voltage GRID can be made constant as a predetermined voltage by changing a collector-emitter voltage of the transistor based on a voltage value by the line current detection signal Sir. That is, the grid voltage GRID can be made constant as the predetermined voltage based on the grid current Ig.

In this embodiment, the ASIC 51 controls the grid constant voltage circuit 71A such that a higher line current Ir (grid current Ig) detected by the line current detecting circuit 72A provides a lower grid voltage GRID (predetermined constant voltage) to be made constant. At this point, the PWM signal Sp2 is generated based on the line current detection signal Sir and is supplied to the reference voltage adjusting circuit 75A.

It is known in the related art that a higher grid current Ig, that is, a higher charging current Ichg, provides a higher surface potential to the photosensitive drums 44. Accordingly, by setting a grid voltage GRID of a color having a higher grid current Ig to be lower, it is possible to prevent the surface potential of the photosensitive drums 44 corresponding to the respective colors from being unbalanced, which may result in prevention of print image quality from being deteriorated. In addition, it is assumed that a relationship between the grid current Ig and the surface potential of the photosensitive drums 44 and a relationship between the grid current Ig and the grid voltage GRID are known by prior experiments or the like.

In addition, the reference voltage adjusting circuit 75A is not limited to the configuration shown in FIG. 3. The reference voltage adjusting circuit 75A may be configured to allow the ASIC 51 to change the reference voltage Vth based on the line current detection signal (voltage signal) Sir.

Other Embodiments

The invention is not limited to the embodiments described in the above description and shown in the drawings. For example, the following embodiments are also intended to fall within the spirit and scope of the invention.

Figure 4:
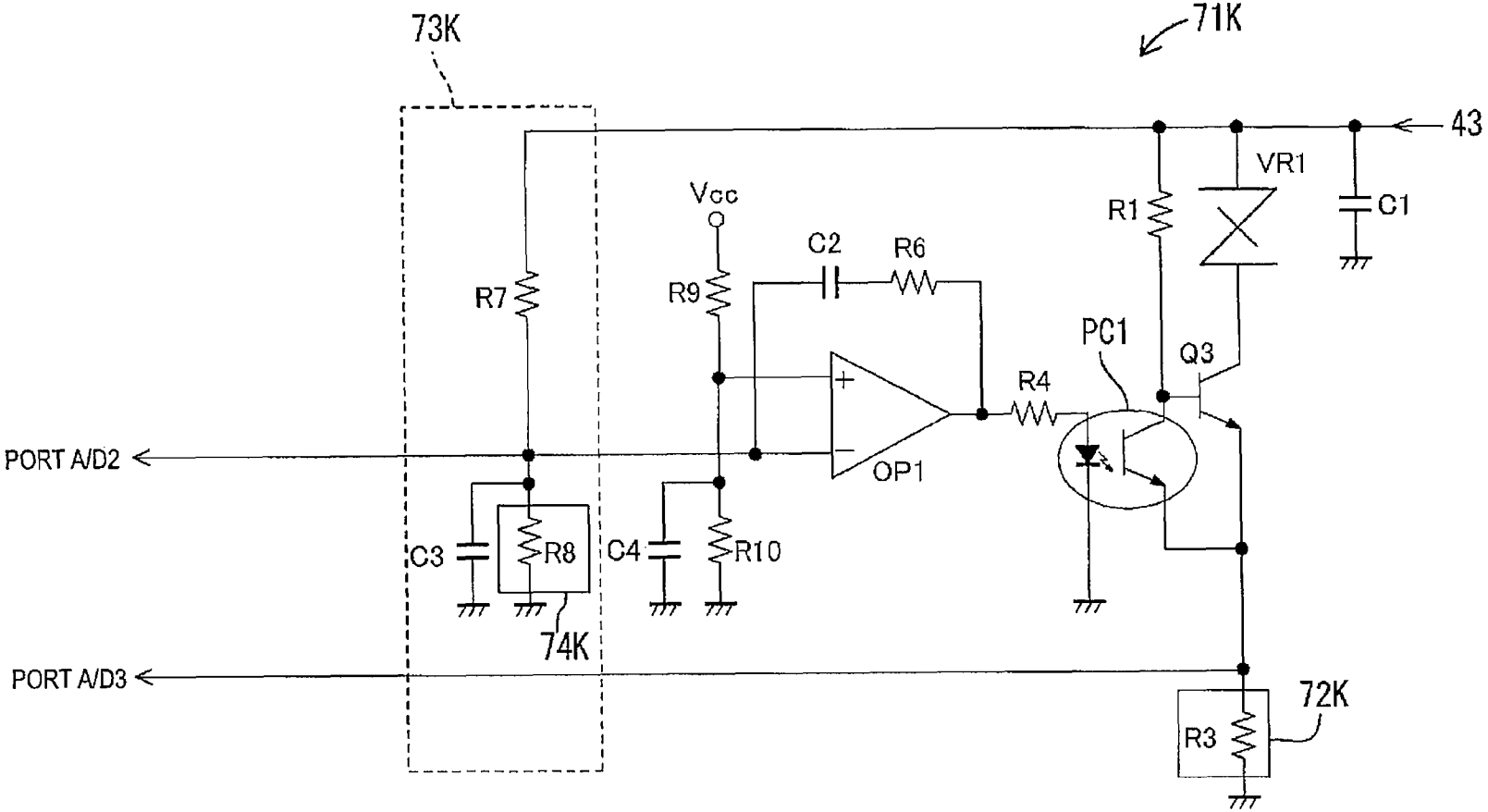
FIG. 4 is a circuit diagram showing another grid constant voltage circuit.

(1) In the above embodiments, as shown in FIG. 4, the grid constant voltage circuit 71 may include a phototransistor PCI as the transistor. In this case, since a current can be prevented from being flowed from the operational amplifier OP1 into the current detection resistor R3, it is possible to detect the line current Ir (second current), that is, the grid current Ig with higher precision. In addition, in the configuration of the grid constant voltage circuit 71 shown in FIG. 2, the phototransistor PC1 may be replaced for the transistor Q1 and may be provided along with the transistor Q2 and a varistor VR1 which are Darlington-connected, as shown in FIG. 4.

(2) In addition, as shown in FIG. 4, the grid constant voltage circuit 71 may include a constant voltage element such as, for example, the varistor VR1, provided between the grid 43 and the transistor in the voltage control line Ln. In this case, a collector-emitter or source-drain withstanding voltage of the transistor can be limited, which may result in improved reliability. In addition, in the configuration of the grid constant voltage circuit 71 shown in FIG. 2, the constant voltage element may be replaced for the resistor R1 and may be connected to the transistor Q2 which is Darlington-connected to the phototransistor PC1, as shown in FIG. 4.

(3) Although it has been illustrated in the above embodiments that the photosensitive drums 44 correspond to the chargers 41 in a one-to-one correspondence (in other words, a photosensitive drum 44 is provided for each color), the invention is not limited thereto. For example, the invention may be applied to a printer (image forming apparatus) in which a plurality of chargers 44 correspond to one photosensitive drum, that is, toner images of various colors are overlapped on one photosensitive drum 44 and are then collectively transferred onto a sheet.

What is claimed is:

1. An image forming apparatus comprising:

one or a plurality of photosensitive drums;

a plurality of chargers each having a grid, which are provided for the one photosensitive drum or are respectively provided for the plurality of photosensitive drums and charge the one or plurality of photosensitive drums;

a voltage applying unit that generates a charging voltage and applies the generated charging voltage to the plurality of chargers in common;

a plurality of grid constant voltage circuits which are respectively provided for the plurality of chargers, each of the plurality of grid constant voltage circuits including:

a voltage detecting unit that detects a voltage based on a grid voltage which is generated in the grid in accordance with the applied charging voltage;

a first current detecting unit that detects a first current flowing into the voltage detecting unit;

a voltage control line that makes the grid voltage constant; and an operation control device that performs a feedback control through the voltage control line such that the detected voltage detected by the voltage detecting unit has a predetermined voltage value;

at least one of second current detecting units which are respectively provided for at least one of the grid constant voltage circuits, and detect a second current flowing into the voltage control line; and a controller that controls the voltage applying unit such that a sum of the first current and the second current corresponding to one of the plurality of chargers becomes a predetermined current value.

2. The image forming apparatus according to claim 1, wherein a plurality of the second current detecting units are respectively provided for the plurality of grid constant voltage circuits, and wherein the controller determines whether or not the second current detecting unit corresponding to one of the chargers detects a minimal second current, and controls the voltage applying unit such that the sum of the first current and the second current corresponding to the charger in which the minimal second current is detected has the predetermined current value.

3. The image forming apparatus according to claim 1, wherein each of the grid constant voltage circuits is connected to an output side of the respective operation control device and includes a transistor which controls a voltage of the respective voltage control line, and wherein each of the second current detecting units detects the respective second current between the transistor and a ground.

4. The image forming apparatus according to claim 3, wherein the transistor includes a control terminal, wherein each of the second current detecting units includes a first resistive element which generates a voltage detection signal for detecting the second current, and wherein the controller makes the voltage of the voltage control line constant by controlling a voltage of the control terminal of the transistor based on a voltage value of the voltage detection signal.

5. The image forming apparatus according to claim 3, wherein each of the grid constant voltage circuits includes a phototransistor as the transistor.

6. The image forming apparatus according to claim 3, wherein the transistor includes a first terminal and a second terminal, and wherein each of the grid constant voltage circuits includes:

a second resistive element, which is interposed between the grid and the first terminal of the transistor, in the voltage control line; and a third resistive element or a constant voltage element, which is interposed between the first terminal and the second terminal of the transistor, in the voltage control line.

7. The image forming apparatus according to claim 3, wherein each of the grid constant voltage circuits includes a constant voltage element, which is interposed between the grid and the transistor, in the voltage control line.

8. The image forming apparatus according to claim 1, wherein the controller controls each of the grid constant voltage circuits such that as a second current detected by the respective second current detecting unit increases, a predetermined constant voltage decreases.

9. The image forming apparatus according to claim 1, wherein each of the chargers is a scorotron type charger that includes a discharging wire and the grid.

10. A method for controlling a plurality of chargers in an image forming apparatus including a plurality of photosensitive drums, a plurality of chargers each having a grid, which are respectively provided for the plurality of photosensitive drums and charge the plurality of photosensitive drums, a voltage applying unit which generates a charging voltage and applies the generated charging voltage to the plurality of chargers in common, and a plurality of grid constant voltage circuits which are respectively provided for the plurality of chargers, each of the plurality of grid constant voltage circuits including a voltage detecting unit, an operation control device, and a voltage control line, the method comprising the steps of:

detecting a voltage by the respective voltage detecting unit, based on a grid voltage generated in the respective grid in accordance with the charging voltage;

making the respective grid voltage constant by the respective operation control device by performing a feedback control through the respective voltage control line such that the detected voltage detected by the respective voltage detecting unit has a predetermined voltage value;

detecting a first current flowing into the respective voltage detecting unit;

detecting a second current flowing into at least one of voltage control lines from the second current flowing into the respective voltage control line; and controlling the voltage applying unit such that a sum of the first current and the second current corresponding to one of the plurality of chargers has a predetermined current value.

* * * * *